United States Patent [19]

Mockrin et al.

[11] 4,033,838

[45] July 5, 1977

[54] RECOVERY OF COPPER FROM WASTE NITRATE LIQUORS BY ELECTROLYSIS

[75] Inventors: Isadore Mockrin, Plymouth Meeting; Martin A. Hobin, Allentown, both of Pa.

[73] Assignee: Kawecki Berylco Industries, Inc., Reading, Pa.

[22] Filed: May 19, 1976

[21] Appl. No.: 687,885

[52] U.S. Cl. ..... 204/103; 204/106

[51] Int. Cl.[2] ..... C25B 1/22; C25C 1/12

[58] Field of Search ..... 204/130, 106, 103

[56] References Cited

UNITED STATES PATENTS 2,128,548 8/1938 White ..... 204/106

2,200,139 5/1940 White ..... 204/106

FOREIGN PATENTS OR APPLICATIONS 643,668 9/1950 United Kingdom ..... 204/106

*Primary Examiner*—R. L. Andrews

*Attorney, Agent, or Firm*—Pennie & Edmonds

[57] ABSTRACT

An electrolytic process for the recovery of copper and regeneration of nitric acid from a waste liquor containing the same comprising adjusting the nitrate and hydronium ion concentrations in the liquor to between about 2 to 12 moles per liter and between about 0.5 to 6 moles per liter, respectively, and subjecting the liquor to electrolysis at a temperature of between about 0° to 55° C. using anodes resistant to oxidation.

11 Claims, 3 Drawing Figures

RECOVERY OF COPPER FROM WASTE NITRATE LIQUORS BY ELECTROLYSIS

BACKGROUND OF THE INVENTION

It is known that in the pickling of beryllium copper and other copper alloys with aqueous nitric acid to remove surface oxides and in other treatment of copper alloy materials with nitric acid, there result large amounts of pickle liquor wastes containing large amounts of nitrate ion, unused nitric acid and dissolved copper in addition to other elements. For example, in the case of beryllium copper pickling, beryllium and cobalt would be present in addition to the copper.

Because of the value of these substances and in order to minimize pollution, efforts have been made in the past to recover the copper and other elements and also to regenerate and recover the nitric acid so it can be recycled for use in pickling. Present procedures, however, have not proven economically and/or commerically feasible. Efforts have included the use of alkali to precipitate the copper from the pickle liquor waste, but this is unsatisfactory in that it results in large volumes of sludge which must be disposed of. Other efforts have included addition of sulfuric acid followed by heating to volatilize nitric acid from the liquor wastes, but this, in itself, entails an additional separate operation involving large amounts of equipment and sulfuric acid for regeneration and must be followed by a separate procedure to recover the sulfuric acid. This is complex and costly. Crystallization of the copper nitrate has also been tried, but this has been unsuccessful because of contamination with other metals, such as beryllium, in the case of the pickling of beryllium copper.

Efforts to rely on electrolysis of the pickle liquor wastes to attempt the formation of copper at the cathode and regeneration of nitric acid at the anode have not been successful because, as is recognized, nitric acid is the solvent of choice for copper and it has not been possible to get good electrolytic removal of the copper.

SUMMARY OF THE INVENTION

A method has now been found for the direct and, if desired, continuous process of treating pickle liquor waste to regenerate nitric acid and recover copper at reasonable cost.

Briefly stated, the present invention comprises an electrolytic process for the recovery of copper and regeneration of nitric acid from waste liquor containing the same comprising adjusting the nitrate and hydronium ion concentrations in the liquor to between about 2 to 12 moles per liter and between about 0.5 to 6 moles per liter, respectively, and subjecting the liquor to electrolysis at a temperature of between about 0° to 55° C. using anodes resistant to oxidation. A preferred embodiment comprises the addition to the waste liquor during electrolysis of a compound capable of reacting with nitrous acid to convert said acid to reaction byproducts incapable of dissolving copper.

DETAILED DESCRIPTION

Figure 1:
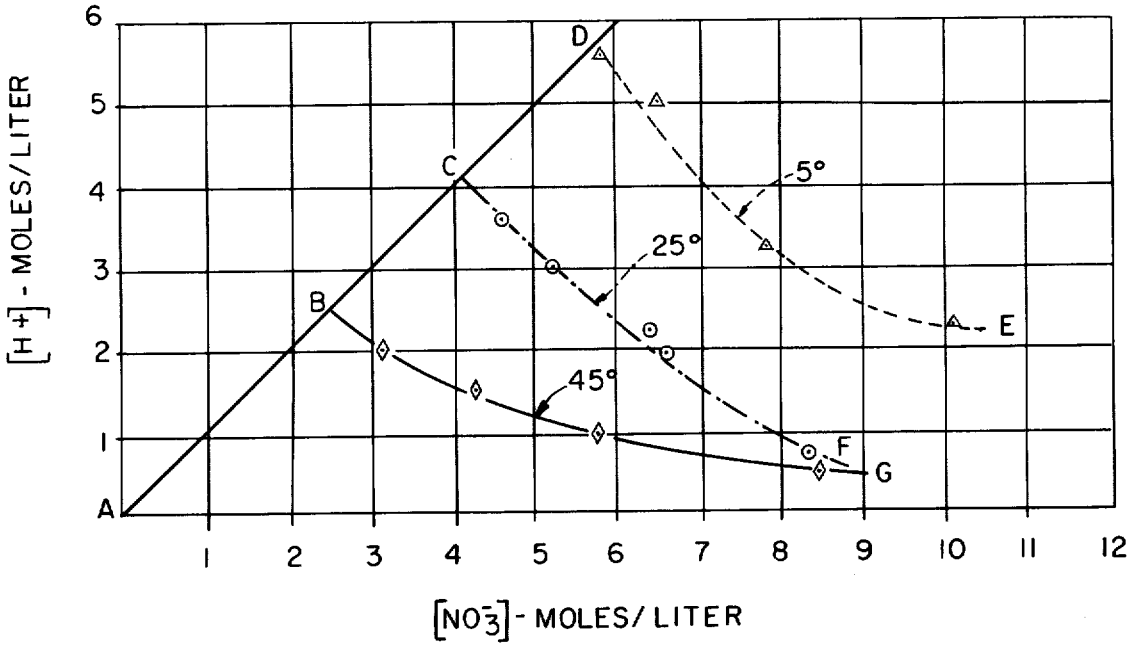
FIG. 1 is a graph depicting areas of operability in accordance with the present invention at various temperatures.

While the instant invention is applicable generally to the recovery of copper and regeneration of nitric acid from waste liquors resulting from the pickling of copper alloys with aqueous acidic solutions containing nitric acid or those resulting from the use of aqueous acids containing nitric acid to "chemically machine" copper alloys, it will be described in connection with the pickling of beryllium copper.

The pickling of beryllium copper with aqueous nitric acid or mixed acids containing nitric acid, for example, nitric acid-sulfuric acid, and the like, is an old and well-known procedure and does not form any part of the instant invention. It is known that the pickle liquor wastes that result contain appreciable amounts of nitrate ion, unused nitric acid and dissolved copper and also beryllium and cobalt. The details of the pickling; namely, concentration of nitric acid, temperature of pickling, pickling time, and the like, are those conventionally used and form no part of the instant invention.

The present invention is directed to electrolysis of liquor waste to form copper at the cathode and regenerate nitric acid at the anode according to the following redox equation:

$$Cu^{++} + H_2O \rightarrow Cu^{\circ} + 2H^{+} + 1/2O_2, \text{ or}$$
$$Cu(NO_3)_2 + H_2O \rightarrow Cu^{\circ} + 2HNO_3 + 1/2O_2$$

By this method, not only is there separation of the copper and nitric acid, but the nitric acid can be recovered and returned directly, and if desired, continuously, to the pickling operation, thus permitting a total recycling. It will be evident also that this permits a continuous automated process in which the pickle waste liquor is continuously removed from the pickle bath, processed in accordance with the instant invention, and the regenerated plus unused nitric acid automatically returned to be added in proper amounts and concentration to the pickling bath.

It has been found that certain conditions are essential in the instant process in order to recover the copper and nitric acid from the pickle liquors containing the $Cu(NO_3)_2$—$HNO_3$ solutions. The first condition is that there be a certain specified concentration of nitrate ion and hydronium ion in the liquor to be treated. It is not clearly understood, but there appears to be a complex relationship between the hydronium ion concentration and the total nitrate concentration and particular proportions of these ions must be present if there is to be proper electrolytic separation. It is believed that one cannot base the conditions of recovery of copper and nitric acid regeneration on the nitric acid concentration alone since there are additional cations such as $Be^{++}$, for example, also present as the nitrate. It has been found that, in order to recover copper and generate the nitric acid, there must be from about 2 to 12 moles per liter of nitrate ion and 0.5 to 6 moles per liter of hydronium ion.

The second, and equally important, condition in the process is control of the temperature in a range of from about 0° to 55° C., preferably 0° to 15° C. Although the copper and nitric acid can be recovered at temperatures ranging from 0° to 55° C., the recovery is not as efficient at the higher temperatures and most efficient recovery is at a temperature range of 0° to 15° C. In this lower range, practically all of the copper and nitric acid can be recovered over the broad range of ion concentrations noted above at relatively high current efficiencies.

The third essential condition is the employment of anodes resistant to oxidation. The redox formula set forth above shows that oxygen is released in the overall electrolysis reaction and can severely damage anodes which are not resistant to oxidation. Oxidation resistant anodes are well-known, examples being the platinum-clad anodes, such as platinum-clad tantalum, platinum-clad niobium, and platinum-clad titanium.

It has also been found that, in carrying out this invention, it is desirable to destroy, i.e., inactivate, any nitrous acid that may be present or formed during electrolysis. Nitrous acid, $HNO_2$, is considered to be a catalyst for the solution of copper in nitric acid. Thus, "removal" of any $HNO_2$ from the solution ensures that the deposited copper will not be redissolved in solution, thus raising the current efficiencies. The use of compounds, therefore, which react with the nitrous acid to convert it into reaction by-products incapable of dissolving copper increases the cathode current efficiency under the given conditions of temperature and ion concentrations set forth above. The preferred reactive compound added is urea, the reaction between urea and nitric acid being:

$$CO(NH_2)_2 + 2HNO_2 \rightarrow 2N_2 + CO_2 + 3H_2O$$

Other reactive compounds which can be used are nitrogen-containing compounds, such as sulfamic acid, amines such as primary and secondary aliphatic and aromatic amines. It is known that amines react readily with $HNO_2$ to give a variety of reactants dependent upon whether the amine to primary, secondary, or tertiary. The reaction with primary amines results in evolution of nitrogen gas; with secondary amines in an N-nitroso compound; and with tertiary amines in complex by-products. It is preferred to use the primary amines and, of these, those which are least expensive. Examples of suitable amines are methylamine, ethylamine, diethylamine, dimethylamine, cyclohexylamine, aniline, diphenylamine, and the like. The compounds also function as does urea to, in effect, reaction with the nitrous acid to convert it into compounds incapable of dissolving the copper.

With respect to the addition of the reactive compounds, it has been found that they are not necessary in carrying out the invention, but they do enable better recoveries of the copper and nitric acid if the electrolysis is going to be carried out at temperatures of about 25° C. and higher. At temperatures in the lower end of the range, that is, 0° to 5° C., such compounds are not necessary.

The following examples are given to further illustrate the scope of the invention and the best mode contemplated for carrying it out; but the examples must not be construed as restricting the invention.

EXAMPLE 1

A series of electrolysis reactions were carried out on identical pickle waste liquors resulting from the pickling of beryllium copper. The electrolyses were carried out at temperatures of 5° C., 25° C., and 45° C. FIG. 1 of the drawings shows the results at various levels of hydronium and nitrate ion concentration at these temperature ranges. Thus, the line ABCD in FIG. 1 represents "pure" $HNO_3$ solutions; that is, no Cu or cation other than hydrogen is present. It will be evident from looking at this FIGURE that the process is temperature dependent with copper deposition occurring at much higher nitrate and hydronium ion concentrations at 5° C. than at 45° C. Moreover, these FIGURES show various suitable operable areas at the various temperatures. Thus, for 5° C. the most suitable operable range is bounded by ADE; for 25° C. by ACF; and for 45° C. by ABG.

EXAMPLE 2

Figure 2:
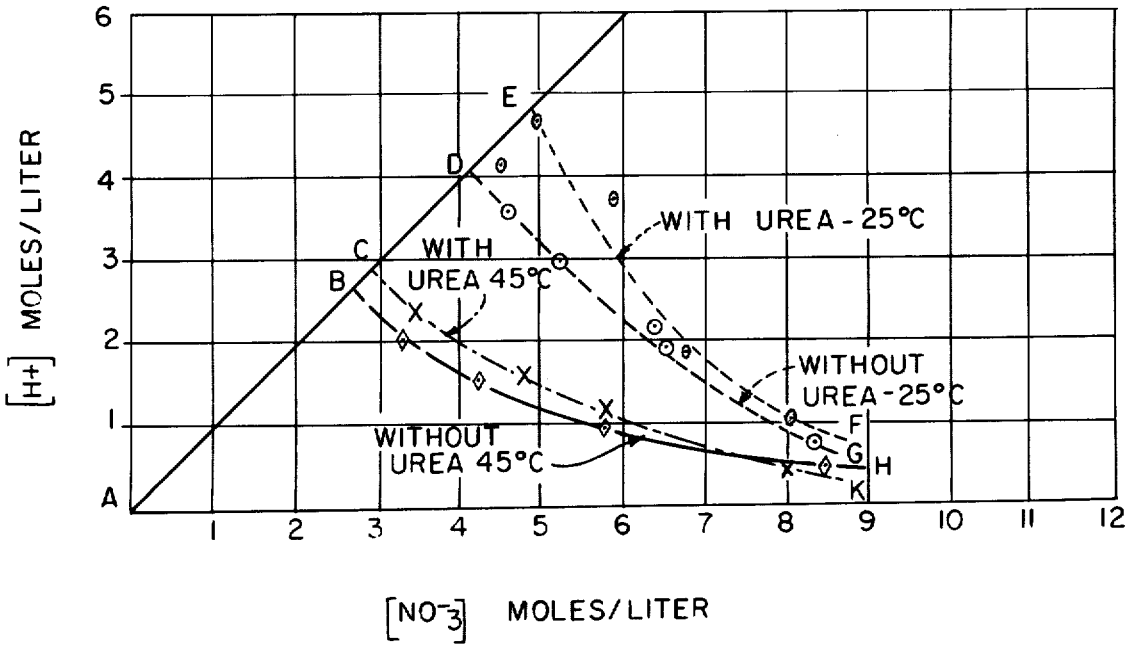
FIG. 2 is a graph showing areas of operability at different temperatures with and without urea addition.

The effect of adding a compound capable of reacting with nitrous acid to avoid redissolving of the copper was tested by adding urea to pickle waste liquor as described in Example 1 which was then electrolyzed in accordance with the present invention and the results are set forth in FIG. 2. This FIGURE shows that the presence of urea increases the hydronium and nitrate concentrations at which copper can be recovered at temperatures of 25° C. and 45° C.

EXAMPLE 3

Figure 3:
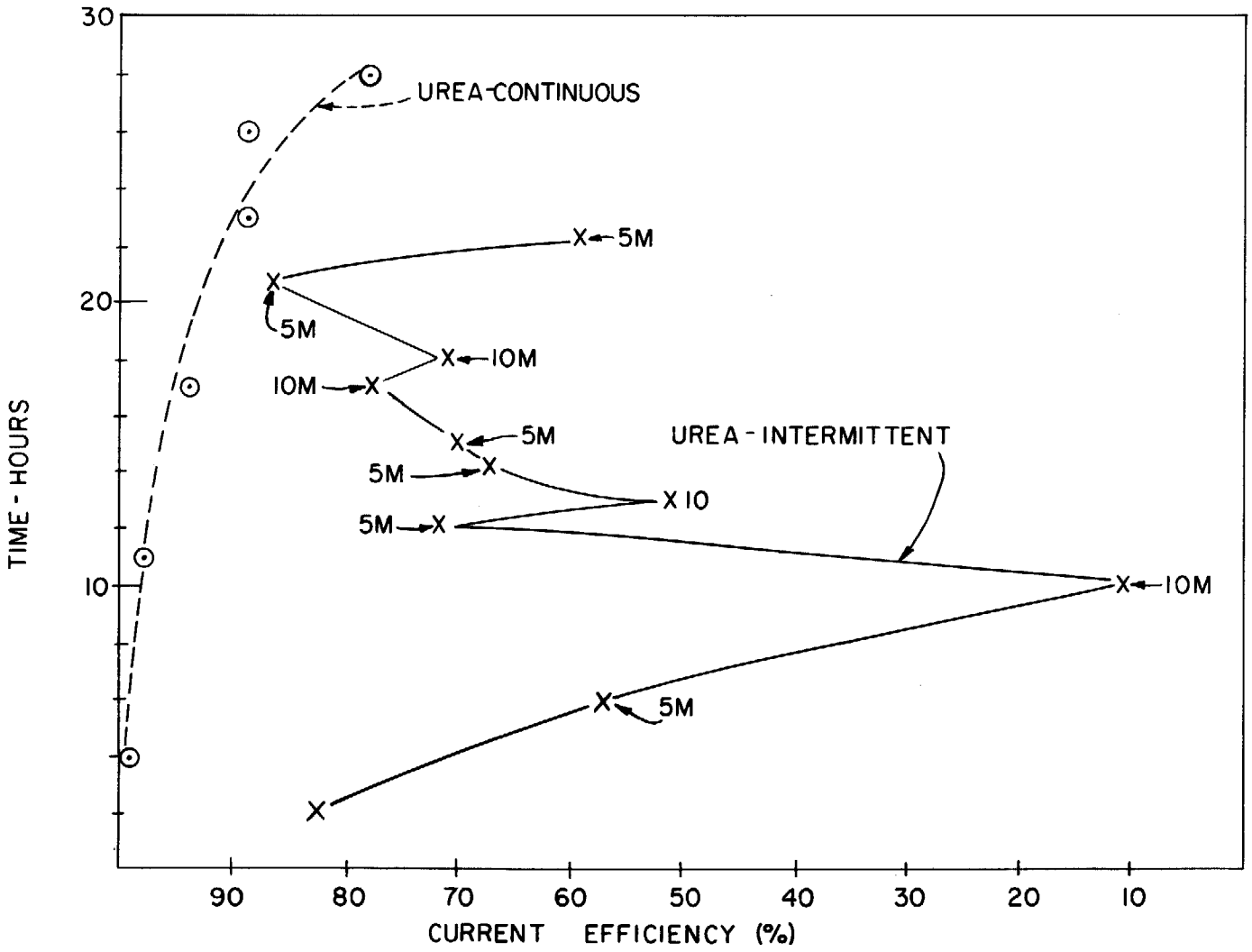
FIG. 3 is a graph illustrating the results obtained by continuous addition of urea as opposed to intermittent addition.

The desirability of adding urea continuously rather than intermittently to the solution during the electrolysis is illustrated in FIG. 3 in which a five-molar aqueous solution of urea was used. In the continuous process shown, 1.5 moles of the five-molar aqueous solution are added per hour at an average current of 240 amperes. In the intermittent addition, the current was the same and again a five-molar aqueous solution of urea is used, but varying amounts are added at the points indicated. It is evident that continuous addition results in a much greater current efficiency at any given period of time.

The pickle waste liquors treated in this example had the following initial and final concentrations:

| | | Solution A Urea Added Intermittent | | Solution B Urea Added Continuous | |
|---|---|---|---|---|---|
| | | Initial | Final | Initial | Final |
| Vol. (l.) | | 190 | 179 | 190 | 175 |
| Conc. | Cu (g/l) | 50.8 | 28 | 47.4 | 12.9 |
| | Be (g/l) | 3.7 | 3.9 | 4.5 | 4.8 |
| | Co (g/l) | 2.2 | 2.3 | 2.9 | 3.1 |
| | $HNO_3$ (M/l) | 2.04 | 2.48 | 2.07 | 3.35 |
| | $NO_3$ (Eq/l) | 4.7 | 4.4 | 4.7 | 5.0 |
| Temp. (° C.) | | 18° | 30° | 18° | 26° |

As previously noted, equally good electrolytic recoveries are obtained from waste liquors resulting from nitric acid pickling of other copper alloys or the chemical machining of copper alloys.

While the invention has been described in connection with a preferred embodiment, it is not intended to limit the invention to the particular form set forth, but, on the contrary, it is intended to cover such alternatives, modifications and equivalents as may be included within the spirit and scope of the invention as defined by the appended claims. 15

What is claimed is:

1. A process for recovering copper and regenerating nitric acid from waste liquors containing nitrate ion or nitrate ion plus unused nitric acid, said process comprising adjusting the nitrate and hydronium ion concentrations in the liquor to between about 2 to 12 moles per liter and between about 0.5 to 6 moles per liter, respectively, and subjecting the liquor to electrolysis at a temperature of between about 0° to 55° C. using anodes resistant to oxidation.

2. A process according to claim 1, including the step of adding to the waste liquor during electrolysis a compound capable of reacting with nitrous acid to convert said acid to reaction by-products incapable of causing the solution of copper.

3. A process according to claim 2, wherein the reacting compound is a nitrogen-containing compound selected from a primary aliphatic amine, secondary aliphatic amine, primary aromatic amine, secondary aromatic amine, sulfamic acid, urea, or mixtures thereof.

4. A process according to claim 1, wherein the oxidation-resistant anode is selected from a platinum-clad tantalum anode, platinum-clad niobium anode, or platinum-clad titanium anode.

5. A process according to claim 1, wherein the waste liquor is the pickle waste liquor resulting from the nitric acid pickling of beryllium copper.

6. A process according to claim 5, including the step of adding to the waste liquor during electrolysis a compound capable of reacting with nitrous acid, said compound being a nitrogen-containing compound selected from the group consisting of primary aliphatic amines, secondary aliphatic amines, primary aromatic amines, secondary aromatic amines, sulfamic acids, and urea.

7. A process according to claim 6, wherein the reacting compound is added continuously to the pickle waste liquor during electrolysis.

8. A process according to claim 6, wherein the nitrogen-containing compound is urea.

9. In a process for pickling a copper alloy with an aqueous acid selected from the group consisting of nitric acid and mixtures of acids containing nitric acid and sulfuric acid or nitric acid and phosphoric acid wherein a pickle waste liquor is formed, the improvement comprising continuously recovering copper and regenerating said nitric acid or mixtures of acids from the waste liquor according to the process of claim 1 and recycling the regenerated acids for use.

10. The process of claim 9, wherein the copper alloy is beryllium copper and the aqueous acid is nitric acid.

11. A process of claim 9, including the step of adding to the waste liquor during electrolysis a compound capable of reacting with nitrous acid to convert said acid to reaction by-products incapable of dissolving copper, said compound being a nitrogen-containing compound selected from the group consisting of primary aliphatic amine, primary aromatic amine, secondary aliphatic amine, secondary aromatic amine, sulfamic acid and urea.

* * * * *